United States Patent [19]

Souma et al.

[11] 4,317,676

[45] Mar. 2, 1982

[54] PROCESS FOR PRODUCING SINTERED IRON ORE HAVING HIGH REDUCIBILITY

[75] Inventors: Hideaki Souma; Norimitsu Konno; Yohzoh Hosotani; Jyuzo Shibata, all of Muroran, Japan

[73] Assignee: Nippon Steel Corporation, Tokyo, Japan

[21] Appl. No.: 96,146

[22] Filed: Nov. 20, 1979

[30] Foreign Application Priority Data

Nov. 22, 1978 [JP] Japan ..... 53-144587

[51] Int. Cl.[3] ..... C22B 1/20

[52] U.S. Cl. ..... 75/5; 266/84

[58] Field of Search ..... 75/3-5; 266/84

[56] References Cited

U.S. PATENT DOCUMENTS

| | | | |
|---|---|---|---|
| 2,750,272 | 6/1956 | Lellup | 75/3 |
| 2,750,273 | 6/1956 | Lellup | 75/3 |
| 2,914,395 | 11/1959 | Davies | 75/5 |
| 2,931,718 | 4/1960 | Greaves | 75/5 |
| 3,249,422 | 5/1966 | Sironi et al. | 75/3 |
| 3,257,195 | 6/1966 | Schwarz | 75/5 |

FOREIGN PATENT DOCUMENTS

| | | |
|---|---|---|
| 655490 | 4/1936 | Fed. Rep. of Germany . |
| 1246254 | 8/1967 | Fed. Rep. of Germany . |
| 1938606 | 2/1971 | Fed. Rep. of Germany . |
| 2414968 | 10/1975 | Fed. Rep. of Germany . |
| 51-52903 | 5/1976 | Japan . |
| 1010488 | 11/1965 | United Kingdom . |
| 1139373 | 1/1969 | United Kingdom . |
| 1153388 | 5/1969 | United Kingdom . |
| 1334247 | 10/1973 | United Kingdom . |

OTHER PUBLICATIONS

Ball, D. F. et al., "Use of Preheated Air in Sintering", *Blast Furnace Coke and Raw Materials Conference* 1960, pp. 409-428, (4/60).

Wenzel, W. et al., "Special Sintering Method with Previous Heat Treatment and Use of Reactive Fuels", *Stahl U. Eisen,* vol. 97, pp. 309-314, (1977).

Japanese Steel Association, *Tekko Binran,* 3rd Edition, Maruzen Co., Ltd., one page unnumbered (1979).

Ball, D. F., *Agglomeration of Iron Ores,* American Elsevier Publishing Co., Inc., p. 312, TN401B3, (1973).

*Primary Examiner*—Michael L. Lewis

*Attorney, Agent, or Firm*—Cushman, Darby & Cushman

[57] ABSTRACT

This invention relates to an improvement of the process for producing sintered iron ore with a Dwight-Lloyd machine, and it provides a process for producing sintered ore with high reducibility by sintering a raw material mix of a moisture content between 4.5 and 8.0% on the pallets of said machine, which comprises drying the surface layer of said mix on the pallets to discharge 3 to 25%, preferably 5 to 20%, of the moisture content of the mix from the sintering system, and thereafter igniting the surface layer of the mix to sinter the same with air or gas sucked downward.

2 Claims, 11 Drawing Figures

PROCESS FOR PRODUCING SINTERED IRON ORE HAVING HIGH REDUCIBILITY

BACKGROUND OF THE INVENTION

1. Field of the Invention

This invention relates to an improvement of the process for producing sintered iron ore with a Dwight-Lloyd machine, and more particularly to a process for producing sintered iron ore having high reducibility as achieved by noting the moisture content of the raw material mix prior to ignition.

2. Description of the Prior Art

To produce sintered iron ore with a Dwight-Lloyd machine, several sintering materials are first combined with a mixer, water is added to the raw material mix, the mix is granulated, the granules are laid down on the pallets of the machine, and are fed to the ignition furnace where the surface of the granule bed is uniformly ignited. The ignited layer lowers down as it is burned with air sucked through the mix bed toward the underside of the pallets; therefore, the sintering reaction proceeds gradually from the surface layer of the mix bed to the lower layer. For the burning layer to proceed quickly and to obtain sintered iron ore having high porosity and reducibility (JIS M 8713) (Japanese Industrial Standard M 8713), it is necessary that ignition bring part or all of the mix bed to a sintered state, therefore the sinter bed must have good permeability to air. Accordingly, efforts are being made to increase the productivity of sintering process by enhancing such permeability, to minimize the use of coke and coke oven gas (COG) necessary for production of sintered iron ore, and to better the quality of the sintered product. The quality of sintered iron ore is commonly expressed by such indices as tumbler index (TI) and shatter index (SI) for indicating the strength at ordinary temperature and degradation index after 550° C. reduction (RDI) for representing the ease of degradation in a reducing atmosphere at relatively low temperature (550° C.). Although attempts have been made to improve these indices, the recent studies on the reduction of the ferrous feed in the blast furnace show the importance of a property at high temperatures such as the reducibility (determined at 900° C. according to JIS M 8713), in addition to TI, SI and RDI as the indices for the quality of sintered iron ore.

Several examples of the prior art processes for providing a sintered ore product with improved quality are described below.

(1) In Blast Furnace Coke Oven and Raw Materials Conference (1960) pp. 409–428 "Use of a Preheated Air in Sintering", D. F. Ball and J. M. Ridgion report the technique of drying preliminarily the raw material mix with hot air prior to ignition. The data given in this article shows that about 70% of moisture is removed from the mix by the preliminary drying which continues for a period equal to the sintering time.

(2) Stahl und Eisen, 97 (1977) 7, 309 discloses the technique of preheating the mix with a low-oxygen gas to a temperature higher than the ignition point of coke to thereby complete dehydration, calcination and reduction steps prior to sintering. The technique aims at complete removal of the moisture content of the mix prior to ignition. Since the article states that the preheating is advantageously effected at 800° C. for a period of about 10 to 15 minutes, this prior art technique requires extended preheating and uses a great amount of energy as a heat source for preheating.

Therefore, the above two prior art techniques that perform preliminary heating of the mix before ignition require a long time to achieve the intended purpose, and in particular, the technique reported in Stahl und Eisen supra that finishes dehydration, calcination and reduction before sintering requires a large volume of heated non-oxidative gas, and therefore, either technique is very difficult to implement with a Dwight-Lloyd machine.

(3) Japanese Patent Public Disclosure No. 52903/76 discloses the technique of elevating only the upper layer of the mix (the top layer 30 mm deep from the surface) to about 200° C. and igniting the layer with reduced thermal impact upon ignition. But this technique does not pay attention to the moisture content of the mix before it is laid down on pallets or to the moisture content of every part of the mix from the top layer to bottom layer after it is laid down on the pallets. The technique intends to decrease the resistance to air permeation of the mix at the top layer to thereby enhance the productivity of the sintering process as well as to reduce the coke consumption, but it does not at all consider the possibility of improving the characteristics of the sintered ore product at high temperatures.

SUMMARY OF THE INVENTION

This invention provides a novel process of carrying out the sintering operation that produces sintered ore with improved quality that is advantageously used as a blast furnace feed. Noting the moisture content of the raw material mix before ignition, this invention has for its object the improvement of the reducibility of sintered ore as one of its characteristics.

In the normal procedure of the sintering process, water is added to the raw material mixture to form pseudo-particles (i.e. some of the true particles of the feed cohere to form apparently large particles with the added water serving as a binder), the mix is laid down on the pallets of a Dwight-Lloyd machine, and as the sintering proceeds, the moisture in the mix is evaporated and carried downward by means of the gas passing through the sinter bed until it is condensed in the intermediate and bottom layers of the mix. As a result, the moisture content of the mix at the intermediate and bottom layers is increased to impair the integrity and the gas permeability of the pseudo-particles. The same phenomenon is observed if the mix on the pallets is heated suddenly because the resultant sudden vaporization of the added water causes the pseudo-particles to break apart into smaller particles.

Noting this fact, this invention comprises supplying the pallets with a raw material mixture having optimum moisture content and drying the surface layer of the mix bed (substantially removing the added water from the mix) to thereby discharge a predetermined percentage of the total moisture content of the mix bed from the sintering system before it is ignited for sintering. By so doing, the moisture content that is condensed at the intermediate and bottom layers of the sinter bed is decreased, the possibility of the pseudo-particles in these two layers to disintegrate is minimized, the number of voids present in these layers is increased, and in consequence, the resultant sintered ore product has a higher porosity, hence, an improved reducibility.

Therefore, the primary object of this invention is to provide a sintered ore product with an improved reducibility which is advantageously used as a blast furnace feed, with attendant reduction in the fuel consumption by the blast furnace.

The above object and advantages of this invention are achieved by any one of the processes described below:

(1) A process for producing sintered ore with high reducibility by sintering a raw material mix of a moisture content between 4.5 and 8.0% on the pallets of a sintering machine, which comprises drying the surface layer of said mix on the pallets to discharge 3 to 25%, preferably 5 to 20%, of the moisture content of the mix from the sintering system, and thereafter igniting the surface layer of the mix to sinter the same with air or other gas sucked downward;

(2) A process according to Paragraph 1 above wherein said surface layer is dried with a hot gas having a temperature between 100° and 500° C.;

(3) A process according to Paragraph 1 or 2 above wherein said surface layer is dried with the exhaust gas from the cooler and/or wind boxes of the sintering machine;

(4) A process according to Paragraph 1, 2 or 3 wherein the moisture content to be discharged from the sintering system through drying is determined from the flow rate of the exhaust gas from the window boxes and the moisture content of said exhaust gas.

(5) A process for producing sintered ore with high reducibility by sintering a raw material mix of a moisture content between 4.5 and 8.0% on the pallets of a sintering machine, which comprises drying the surface layer of said mix on the pallets so that it is dried by thickness equal to 8 to 31%, preferably 15 to 27%, of the thickness of the mix bed, and thereafter igniting the surface layer of the mix to sinter the same with air or other gas sucked downward;

(6) A process according to Paragraph 5 wherein the surface layer of the mix has been preheated to a temperature between 100° and 500° C. on drying thereof;

(7) A process according to Paragraph 5 or 6 wherein the thickness of surface layer of said dried mix is measured and the flow rate and temperature of the heated gas as well as the travelling speed of the pallets are controlled so that the measured thickness of said surface layer is within the range of from 8 to 31%, preferably from 15 to 27%, of the thickness of the mix bed.

(8) A process according to Paragraph 5, 6 or 7 wherein the thickness of the surface layer of said dried mix is that of the zone of said mix bed which has a temperature of at least 100° C.

DETAILED DESCRIPTION OF THE INVENTION

Figure 1:
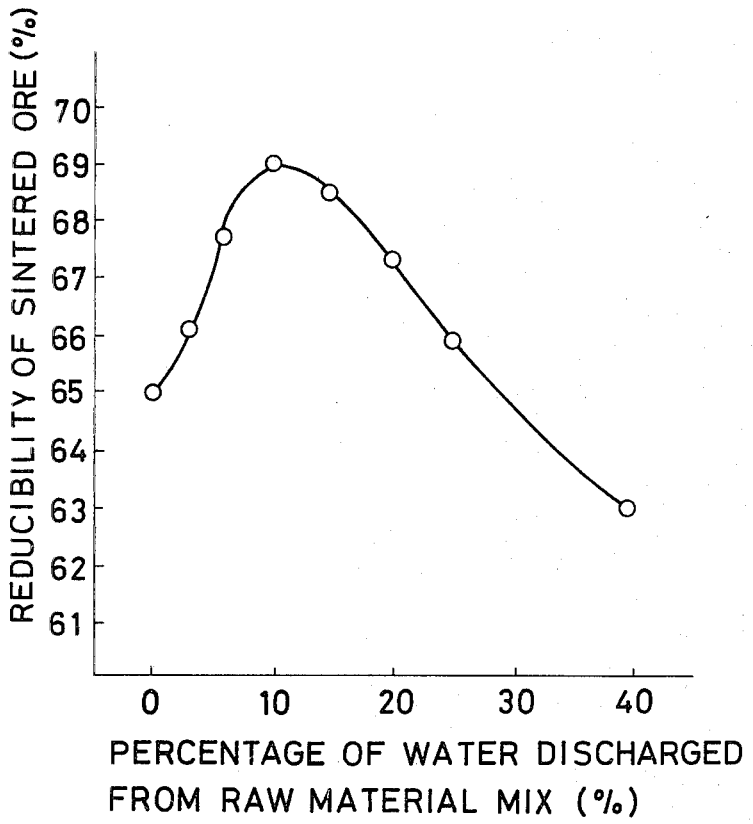
FIG. 1 is a graph showing the relationship between the percentage of water discharged from the raw material mix and the reducibility of the resultant sintered ore.

This invention will hereunder be described in detail by reference to the accompanying drawings. FIG. 1 is a graph showing the relationship between the percentage of water discharged from the raw material mix and the reducibility of the resultant sintered ore as determined in accordance with JIS M 8713. This invention has been accomplished on the basis of the finding that the two factors are closely related to each other as illustrated in FIG. 1.

TABLE 1

| Description of Sintering Materials and Their Proportions | |
|---|---|
| Limestone | 11.0 (%) |
| Silica | 0.8 |
| Scale | 3.0 |
| Iron sand | 3.0 |
| MBR | 6.0 |
| Bailadila | 6.0 |
| Robe River | 6.0 |
| Hamersley | 7.0 |
| Mt. Newman | 11.0 |
| Quebec | 2.0 |
| Carol | 2.0 |
| Swaziland | 8.0 |
| Rio Doce CF | 16.2 |
| Miferna | 6.0 |
| Salgaoncar | 12.0 |
| Return fines | 20.0 |

TABLE 2

| Grain Size Distribution of Raw Material Mix | | | | | |
|---|---|---|---|---|---|
| Grain size (mm) | 10–5 | 5–2 | 2–1 | 1–0.5 | 0.5 |
| Grain size distribution (%) | 22.2 | 33.1 | 14.0 | 10.7 | 20.2 |

The inventors of this invention combined 3.1% of coke with a feed comprising a mixture of the indicated materials in the indicated proportions (Table 1) and having the grain size distribution indicated in Table 2, added 6.0% of water to the raw material mix, granulated the mix, laid down the granules on pallets to form a bed 600 mm thick, dried the surface layer of the mix bed to discharge part of the moisture content from the sintering system, ignited the surface layer of the bed, and sintered the mix with air or other gas sucked downward. As a result, they found that the reducibility of the sintered product varied greatly with the percentage of water discharged, as demonstrated in FIG. 1. To be more specific, as the percentage of water discharged increased, the reducibility kept rising until it reached the peak at a predetermined level of said percentage, and decreased thereafter with the increase in said percentage. It is clear from FIG. 1 that the reducibility is greater than 66% at a percentage of water discharged between 3 and 25%, giving a significantly high level at a percentage of water discharged between 5 and 20%.

The reason that a raw material mix so controlled as to have an optimum moisture content before it is laid down on pallets and which is ignited for sintering only after about 3 to 25%, preferably 5 to 20%, of the moisture content in the mix is discharged from the sintering system provide a sintered ore product having improved reducibility is because less moisture is condensed in the lower layer of the sinter bed, thus minimizing the disintegration of the pseudo-particles in that layer to thereby retain the necessary voids, with the attendant improvement of the porosity of the sintered product. In the conventional sintering process, as the sintering proceeds, the water in the mix is evaporated, carried downward by the gas passing through the sinter bed and is condensed in the intermediate and bottom layers of the sinter bed to increase the moisture content in these layers. Such phenomenon can be effectively avoided by reducing the moisture content in the mix prior to ignition. However, if the moisture content of the mix is reduced before it is laid down on pallets, the granule-forming tendency of the mix is impaired and the potential growth of pseudo-particles is checked, and accordingly, not only does it become impossible to improve the air permeability of the sinter bed during sintering but also more water is condensed in the lower layer of the sinter bed, resulting in a complete failure to achieve the purpose of this invention. Therefore, the effective method of reducing the water content of the mix without adversely affecting its granule-forming tendency is to lay a mix of pseudo-particles down on pallets and thereafter discharge part of the moisture content of the mix from the sintering system prior to ignition for sintering. Discharge of the moisture content is accomplished by supplying the surface layer of the mix with dry gas or exhaust gas which is sucked downward simultaneously. In the above description, it is assumed that the raw material mix contains 6.0% of water for granulation. However, the actual level of initial moisture content varies within the range of from 4.5 to 8.0%, mostly between 5 and 7%, with the optimum level being determined by the type of sintering materials, their proportions and the grain size distribution of the mix. The process of this invention is applicable to all variations of raw material mix that have been so controlled as to contain moisture within the above defined range.

As noted in the foregoing, according to this invention, 3 to 25%, preferably 5 to 20%, of the water content in the raw material mix on the pallets is discharged from the sintering system. If less than 3% of water is discharged, the intended effect of this invention is not exhibited to the fullest, whereas discharging more than 25% of water produces only a too broad heated zone having great resistance to gas permeation during sintering, thus causing a decrease in the quality, especially the reducibility, of the resulting sintered ore. As moisture is discharged from the mix, a dry moisture-free zone is formed on the surface layer of the mix. The thickness of the dry layer undergoes a fine but by no means great variation depending upon not only the thickness of the mix bed and the moisture content discharged therefrom but also the flow rate, temperature and humidity of the gas to be passed through the mix bed for moisture removal.

Figure 2:
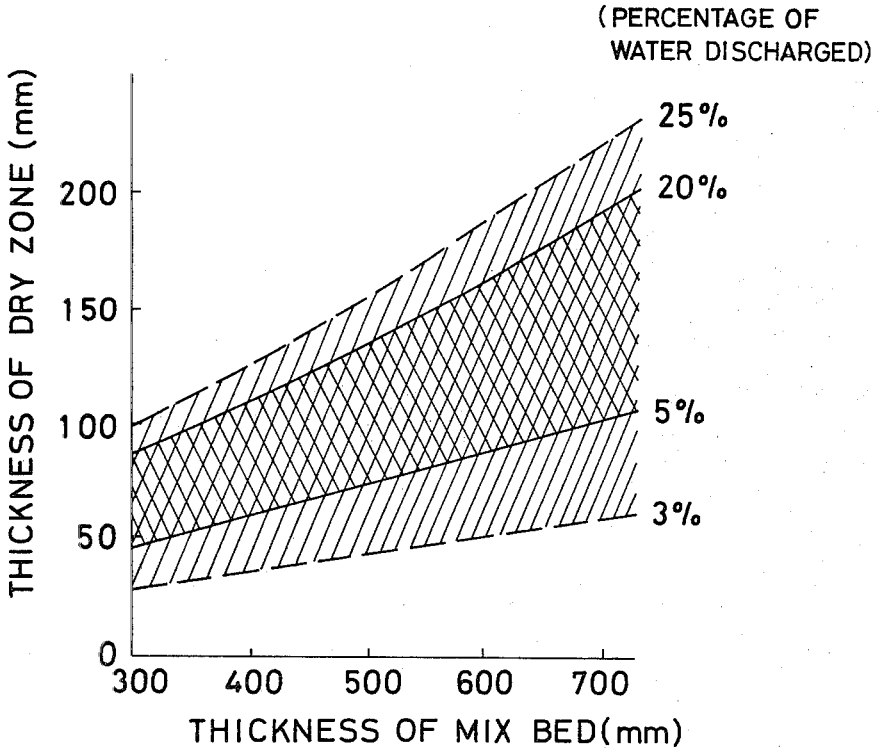
FIG. 2 is a graph showing the range of the percentage of water to be discharged prior to ignition in the process of this invention.

FIG. 2 shows the relationship between the percentage of water discharged from varying depths of the raw material mix bed and the thickness of the dry zone formed on the surface layer of the mix bed, as determined when 0.7 $Nm^3/m^2sec$ of a dry hot gas (300° C.) was passed through the mix bed from above. In FIG. 2, the area shaded with parallel oblique lines indicates a zone where the effect of this invention is brought about, and the crosshatched area represents a preferred range. If indicated in terms of the thickness of dry zone based on that of the raw material mix bed, the area shaded with parallel oblique lines and the crosshatched area are equivalent to ranges of 8 to 31% and 15 to 27%, respectively. Namely, the moisture content discharged between 3 and 25% according to the process of this invention is equivalent to drying the surface layer of the mix until 8 to 31% of the thickness of the mix bed is dry, and the moisture content discharged between 5 and 20% is equivalent to drying the surface layer of the mix bed until 15 to 27% of the thickness of the mix bed is dry.

It is to be noted here that the process of this invention can be directly applied to a conventional Dwight-Lloyd machine in which the general thickness of the bed of raw material mix to be sintered is at least about 400 mm.

The mechanism by which drying the surface layer of the raw material mix bed and discharging 3 to 25% of the total moisture content of the mix from the sintering system results in improved reducibility of the sintered product will hereunder be described.

Figure 3:
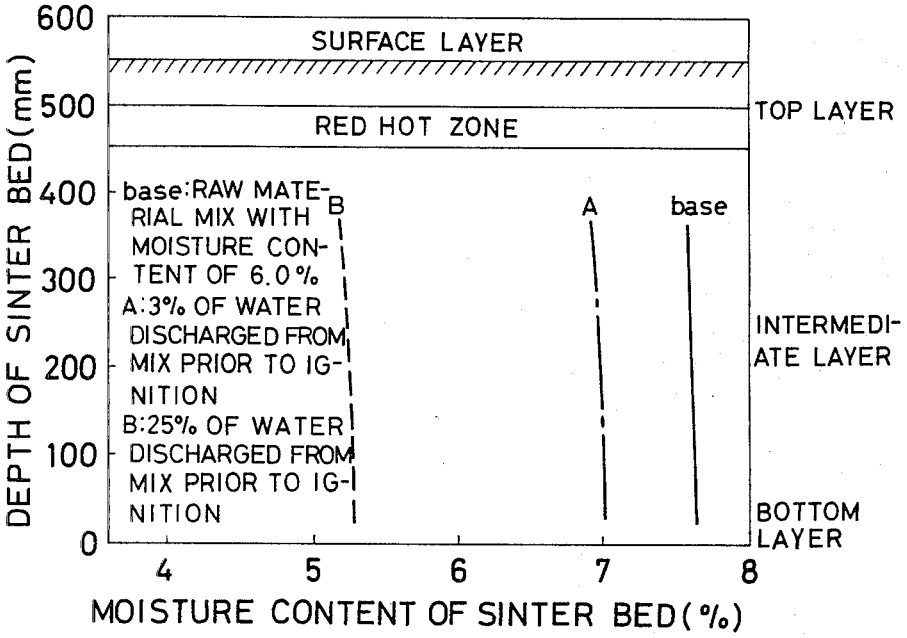
FIG. 3 is an illustration of water condensation as occuring in the intermediate and bottom layers of the sinter bed.
Figure 4:
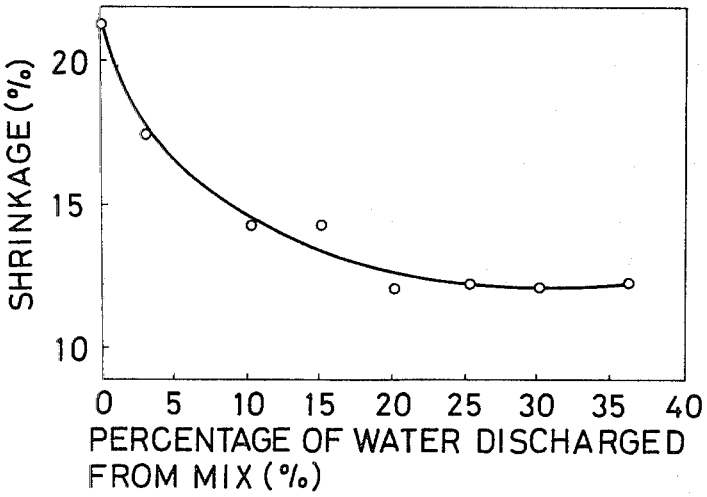
FIG. 4 is a graph showing the relationship between the percentage of water discharged from the raw material mix and the shrinkage of the sinter bed after sintering.

If the surface layer of the mix bed on the pallets is dried and moisture equal to 3 to 25% of the total moisture content of the mix is discharged from the sintering system prior to ignition, a dry zone is formed on the surface of the mix bed and the total moisture content of the mix is decreased to a level between 4.5 and 5.8% of the initial moisture content which is assumed here to be 6.0% for the purposes of the present description. In consequence, less water is condensed in the intermediate and bottom layers of the sinter bed during sintering, as exemplified in FIG. 3, and less thrinkage occurs in the direction of the thickness of the bed, as is seen from FIG. 4 which shows the shrinkage of the sinter bed that occurred in the direction of its thickness when a raw material mix having a moisture content of 6.0% was placed on pallets, supplied with a hot gas (350° C.) at its surface layer, which gas was sucked downward to thereby discharge part of the total moisture content of the mix from the sintering system, followed by ignition at said surface layer for sintering with suction applied downward to produce sintered ore. The shrinkage was determined by the following formula: $(A-B)/A\times 100$ (wherein A is the thickness of the mix bed prior to sintering, and B is the thickness after sintering). As is readily understood from FIG. 4, the more water discharged from the raw material mix, the less shrinkage occurs. The decrease in the shrinkage is noticeable when more than 3% of water is discharged, and shrinkage stops if more than 25% of water is discharged. Little shrinkage in the sinter bed means many voids are present in the intermediate and bottom layers of the bed, which is the result of less disintegration of pseudo-particles due to less condensation of water in those layers. The increase in the number of voids present in the sinter bed results in the increased porosity, hence improved reducibility, of the sintered product. If air or exhaust gas heated to at least 100° C. is used to discharge 3 to 25% of the moisture content of the raw material mixture from the sintering system, the surface layer of the mix becomes preheated to 100° C. or more, and this helps reduce the consumption of coke and COG, which in turn reduces the FeO content of the sintered ore. The lower FeO content leads to a further improvement of the reducibility of the sintered product.

Figure 5:
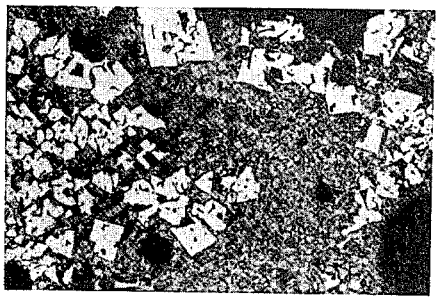
FIG. 5 is a micrograph (100×) of the sintered ore as produced by the conventional process.
Figure 6:
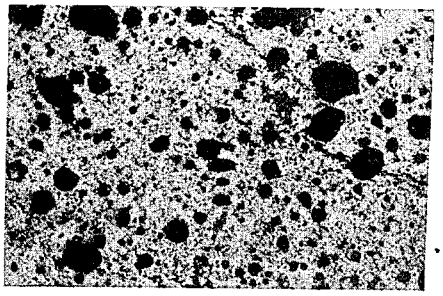
FIG. 6 is a micrograph (100×) of the sintered ore as produced by the process of this invention.

FIGS. 5 and 6 are micrographs (100×) of the sintered ore products produced by the conventional process and the process of this invention, respectively. Both sintered products were prepared from a raw material mix comprising a mixture of the indicated sintering materials in the indicated proportions (Table 1) and having the indicated grain size distribution (Table 2), which was conditioned to have a moisture content of 6.0% through addition of water and laid down on pallets to form a bed 600 mm thick which was then ignited at its surface for sintering with air sucked downward. In the conventional process, the raw material mix contained 3.3% of coke and no water content was discharged from the mix prior to ignition, whereas in the process of this invention, the raw material mix contained 3.1% of coke, and 15% of the moisture content was discharged from the mix prior to ignition by supplying hot air (350° C.) onto the surface layer of the mix bed and sucking said air downward.

As is clearly observed from FIG. 5, the sintered ore produced by the conventional process had a microstructure mainly consisting of calcium ferrite and hematite and containing a limited number of voids. In contrast, as shown in FIG. 6, the product sintered by the process of this invention had a microstructure comprising a mixture of silicate slag, magnetite and hematite and containing a great number of voids. Therefore, the micrographs of FIGS. 5 and 6 also demonstrate that the sintered product obtained by the process of this invention has a higher porosity than that of the product sintered by the conventional process.

Various possible methods of controlling the percentage of water discharged from the raw material mix in the practice of the process of this invention are now described below.

(1) Control by direct measurement of moisture as discharged from the raw material mix into the external environment This method uses a commercially available flue exhaust gas moisture meter to measure the moisture content in the exhaust gas and a flow meter such as a Pitot tube to measure the flow rate of the exhaust gas to thereby determine the moisture content contained in the exhaust gas and discharged from the sintering system. From the determined value is calculated the ratio of the moisture discharged to the total moisture content of the mix. The ratio is controlled to be within the range of from 3 to 25%, preferably from 5 to 20%, by regulating flow rate and temperature of the heated gas supplied to the mix as well as the travelling speed of the pallets on which the mix is laid down.

Figure 7:
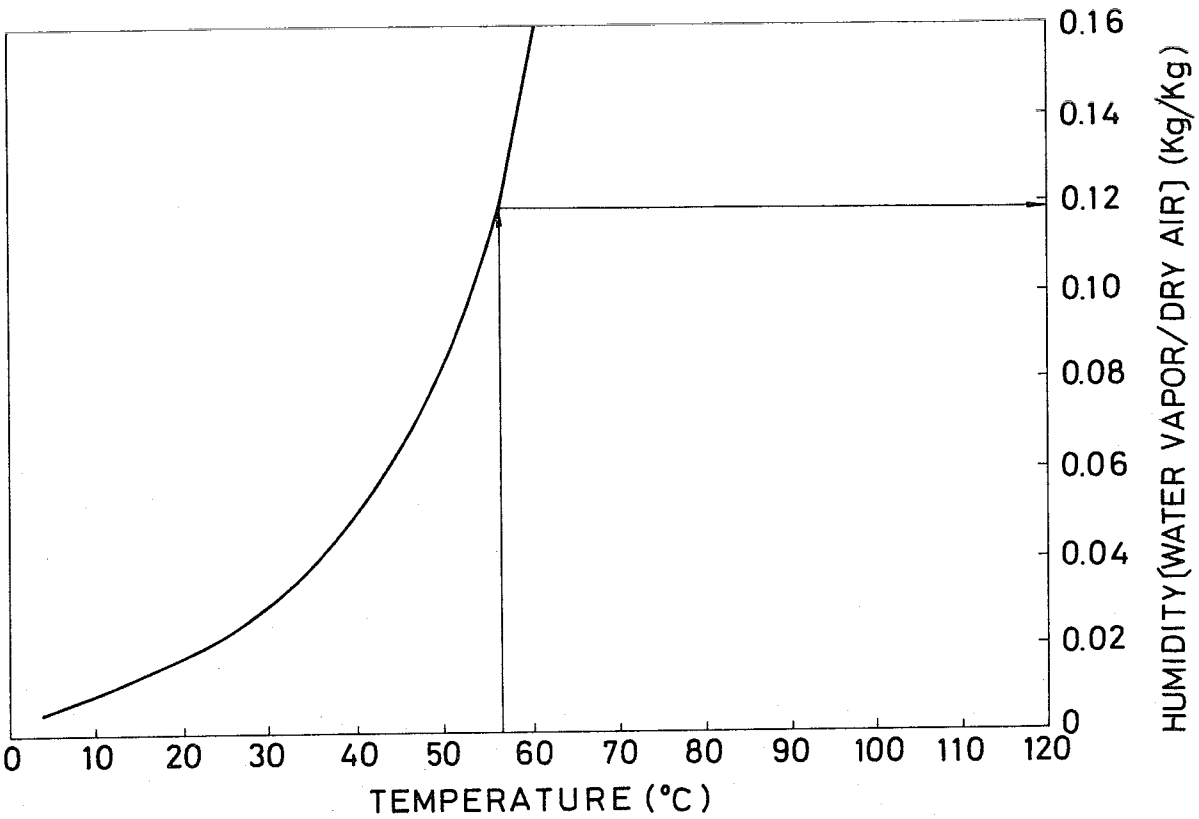
FIG. 7 is a humidity chart.

(2) Control by indirect measurement of moisture as discharged from the raw material mix into the external environment This method measures indirectly the moisture content in the exhaust gas by measuring the temperature of said gas containing the moisture discharged, and uses a method otherwise identical to the method (1) to control the percentage of water discharged. To be more specific, since the sinter exhaust gas is generally saturated with moisture except for the last stage of sintering, a measured temperature of the exhaust gas is plotted on the humidity chart of FIG. 7 to determine the moisture content in the gas. It therefore becomes possible to follow the same procedure of the method (1) by measuring simultaneously the flow rate of the exhaust gas with a Pitot tube or other suitable flow meter.

(3) Control by measuring the thickness of the dry zone formed on the raw material mix This method can be applied if air or exhaust gas heated to at least 100° C. is used to dry the surface layer of the mix until part of the moisture content is discharged from the sintering system. Since the dry zone on the surface layer has been preheated, the precentage of water discharged can be controlled by regulating the thickness of the dry moisture-free zone heated to 100° C. or more through direct measurement with a temperature sensing element such as a thermocouple. Making use of FIG. 2 that indicates the preferred range of dry zone as determined from the thickness of the mix bed and the percentage of water discharged, one can control said percentage by regulating the flow rate and temperature of the heated gas as well as the travelling speed of the pallets so that the measured thickness of the dry zone is within said preferred range.

The process of this invention is now described in greater detail by reference to the following examples and comparative examples.

EXAMPLES 1 to 5 and Comparative Examples 1 and 2

Fresh raw materials (iron ore, limestone, silica and scale) were combined with return fines and coke to form raw material mix to which was added water to attain an initial moisture content of 6.0%. The mix was granulated, placed in 60 kg test pot, and subjected to a sintering test under a negative pressure of 1700 mmAq. The ignition time was 1.5 minutes and the bed of the mix was 600 mm thick. For the description of the components of the mix and their proportions, see Table 1, and for the grain size distribution of the mix, see Table 2 given hereinabove. The proportion of return fines was 20% (See Table 1). The proportions of the components were so selected that the $SiO_2$ and $Al_2O_3$ contents of the sintered product were 5.60% and 2.00%, respectively, and that the $CaO/SiO_2$ of the product was 1.30. For comparison, the proportion of coke incorporated in the mix was varied in the range of from 3.3% to 3.0.

The testing was conducted under the conditions set forth in Table 3 above. Prior to ignition, air heated to 350° C. was supplied to the surface layer of the mix bed and sucked downward to thereby discharge 3 to 25% of the total moisture content of the mix from the sintering system. For the purpose of comparing with the process of this invention, tests were also conducted without discharging any moisture from the mix and with 40% of moisture discharged from the mix. The water content discharged from the sintering system was measured directly with a moisture meter inserted in a window box of the test pot, and the result was combined with that of measurement of the flow rate of the exhaust gas to therey determine the moisture content discharged from the mix into the external environment. The result did not greatly differ from that of another method comprising measurement of the temperature of the moisture-containing exhaust gas discharged into the window box and using the humidity chart of FIG. 7 to calculate the moisture content in said exhaust gas to thereby determine the moisture content discharged into the external environment.

TABLE 3

| | percentage of water discharged prior to ignition (total moisture content of mix = 100) | bed thickness | initial moisture content (%) | coke (%) | sintering time (min) | yield of sintered product (%) | coke consumption (1kg/l − s) | COG consumption (Nm'/l − s) | shatter index (%) | RDI (%) | porosity (%) | FeO content (%) | reducibility (%) |
|---|---|---|---|---|---|---|---|---|---|---|---|---|---|
| Com. Ex. 1 | 0 | 600 | 6.0 | 3.3 | 20.7 | 76.5 | 48.9 | 5.0 | 86.0 | 32.0 | 33.1 | 5.2 | 65.0 |
| Com. Ex. 2 | 40 | 600 | 6.0 | 3.0 | 22.5 | 76.8 | 44.0 | 4.0 | 87.0 | 36.0 | 37.0 | 6.7 | 63.0 |
| Ex. 1 | 3 | 600 | 6.0 | 3.2 | 19.0 | 76.7 | 47.4 | 4.5 | 86.2 | 31.0 | 34.2 | 5.1 | 66.1 |
| Ex. 2 | 6 | 600 | 6.0 | 3.2 | 17.1 | 77.7 | 46.7 | 4.5 | 86.5 | 30.9 | 34.5 | 4.9 | 67.7 |
| Ex. 3 | 10 | 600 | 6.0 | 3.1 | 16.8 | 77.3 | 45.7 | 4.5 | 85.8 | 33.0 | 36.9 | 4.9 | 69.0 |
| Ex. 4 | 15 | 600 | 6.0 | 3.1 | 17.7 | 77.0 | 45.6 | 4.0 | 86.1 | 33.5 | 36.8 | 5.0 | 68.5 |
| Ex. 5 | 20 | 600 | 6.0 | 3.0 | 19.3 | 76.7 | 44.8 | 4.0 | 85.6 | 32.3 | 36.9 | 5.6 | 67.3 |
| Ex. 6 | 25 | 600 | 6.0 | 3.0 | 20.5 | 76.9 | 44.7 | 4.0 | 86.5 | 32.6 | 37.4 | 5.9 | 65.9 |

Figure 10:
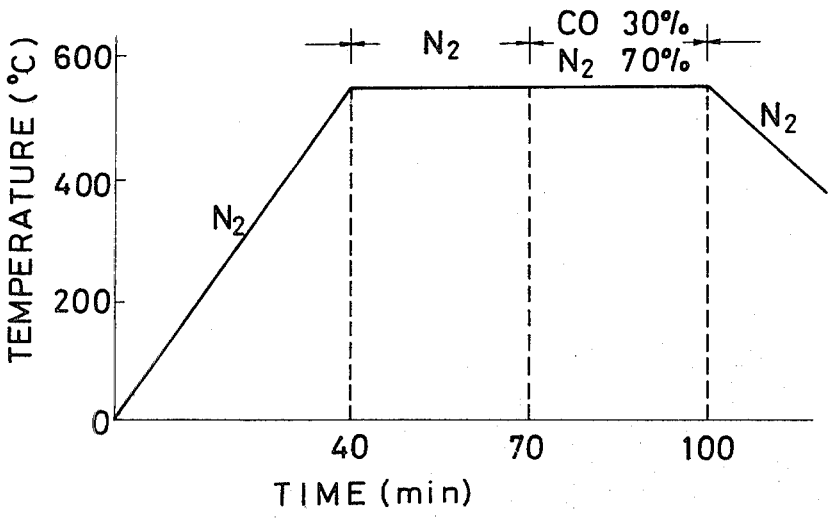
FIG. 10 is a graph indicating the conditions for testing RDI.

The degradation index after 550° C. reduction (RDI) was determined by rotating in a mini-drum a sintered ore product reduced at 550° C. and the fine fraction indicated by −3 mm%. The testing conditions are set forth in Table 4 and FIG. 10.

TABLE 4

| Method of RDI Test | |
|---|---|
| (1) Sample | |
| Size | 15–20 mm |
| Weight | 500 gr |
| (2) Condition of Reduction | |
| Gas content | CO 30% $N_2$ 70% |
| Gas volume | 15 l/min |
| Temperature | 550° C. |
| Time | 30 min |
| (3) Drum test after reduction | |
| Drum | $130^{\phi} \times 100^{L}$ (mm) |
| Number of revolutions | 30 r.p.m. |
| Retention time | 30 min |
| Indication | −3 mm % |

Figure 8A:
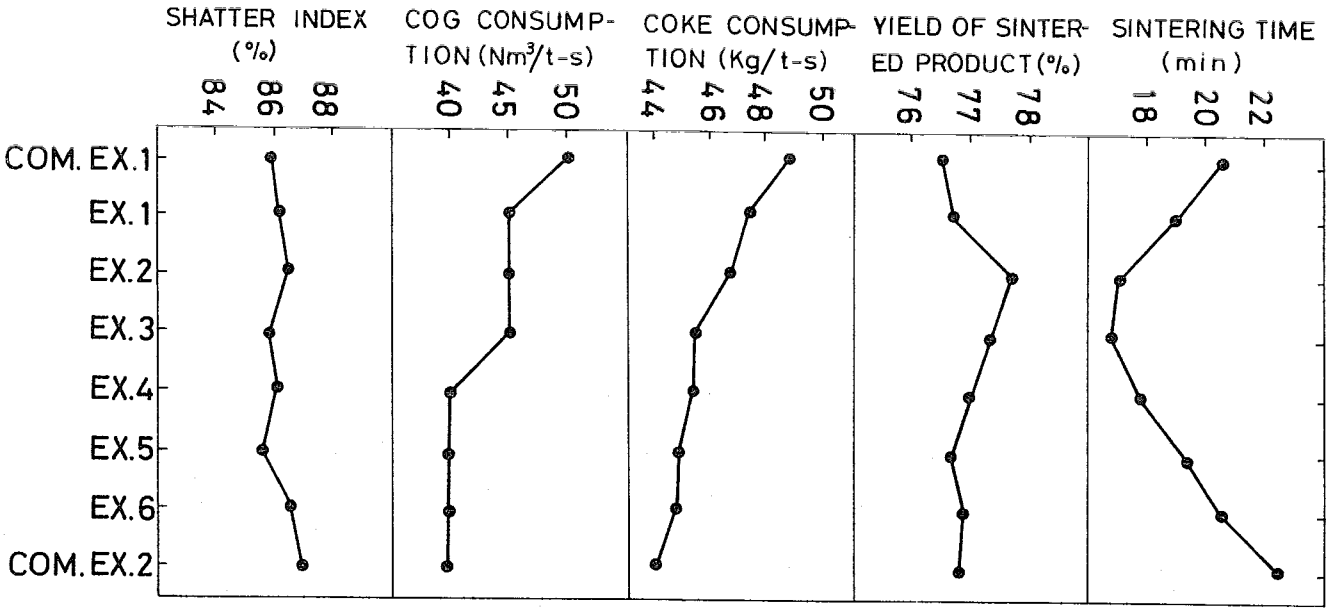
FIGS. 8(A) and (B) compare the process of this invention with the conventional process in respect of the sintering period, yield of the sintered product, coke consumption, COG consumption, shatter index, RDI, porosity, FeO content of sintered ore, and its reducibility.
Figure 8B:
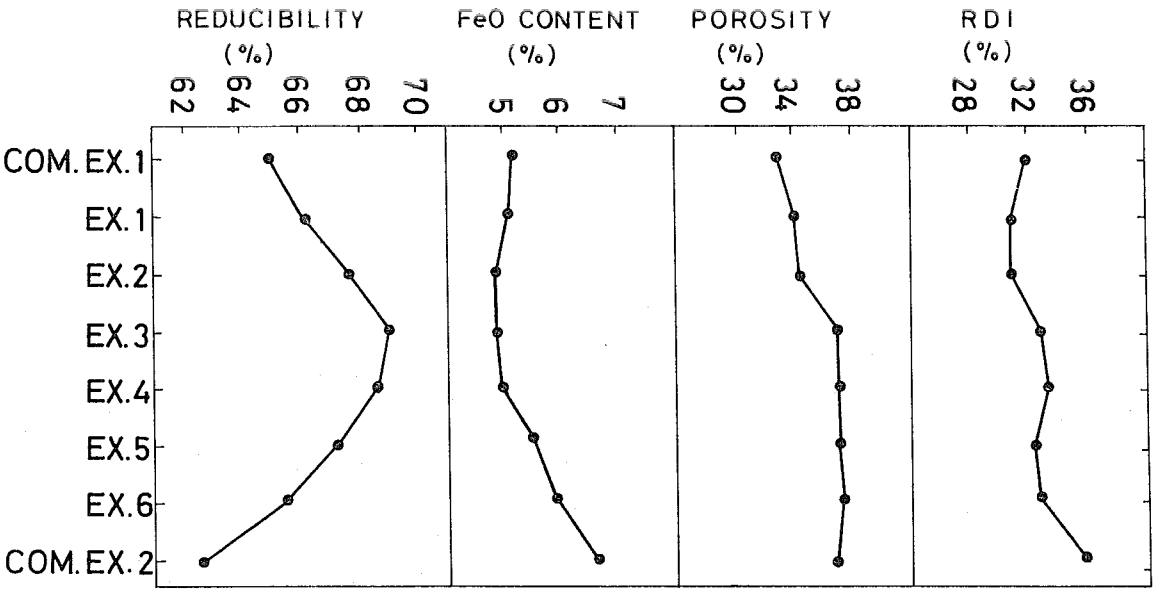

The results of the sintering testings are indicated in Table 3 with respect to the sintering time, yield of the sintered product, coke consumption, COG consumption, shatter index, RDI, porosity of the sintered product, FeO content of the sintered product and its reducibility. FIGS. 8(A) and (B) graph these results for each testing item. As Table 3 and FIG. 8 clearly show, the process of this invention provides a sintered product with increased porosity and improved reducibility. It is also to be noted from the above results that if more than 25% of moisture was discharged from the raw material mix prior to ignition, a sintered ore product having low reducibility was produced. This fact supports the conclusion that not more than 25% of water shall be discharged from the mix according to this invention.

Figure 9:
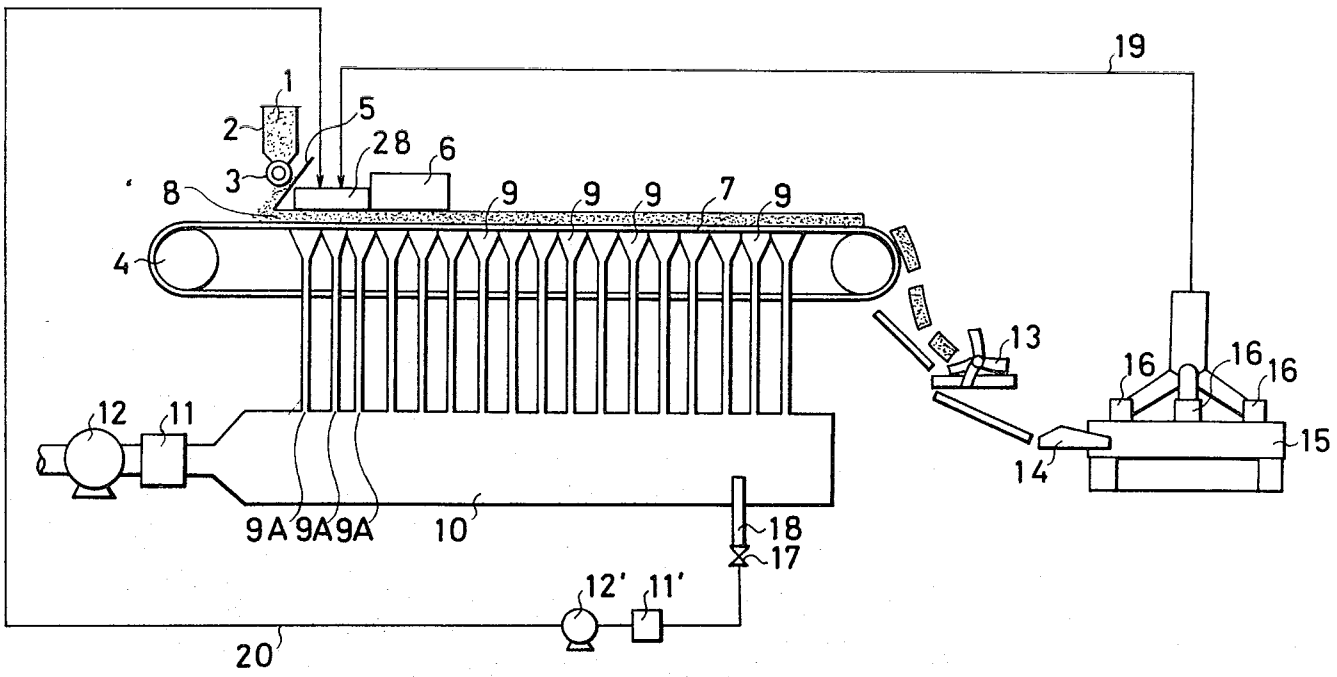
FIG. 9 is an illustration of one embodiment of the process of this invention.

The process of this invention will hereunder be described in connection with FIG. 9 that shows one embodiment of the invention using a Dwight-Lloyd machine. As the figure indicates, a raw material mix 1 in a hopper 2 is fed continuously on pallets 7 through a drum feeder 3 and a sloping plate 5. A sprocket 4 on the feed end is rotated to transport a mix 8 on the pallets 7 slowly into an ignition furnace 6 where the surface layer of the mix is ignited. All layers of the sinter bed are subjected to sintering reaction with air or other gas sucked by a suction blower 12 through a plurality of window boxes 9, 9, . . . beneath the pallets, a main duct 10 and through a dust precipitator for exhaust gas 11, while the resultant sintered ore is discharged continuously at the discharge end. With the use of such Dwight-Lloyd machine, the process of this invention dries the surface layer of the mix bed on the pallets 7 to discharge 3 to 25% of the total moisture content of the mix from the sintering system prior to ignition for sintering. By specific reference to FIG. 9, the mix 8 is transferred to a preheat/drying furnace 28 disposed between the ignition furnace 6 and sloping plate 5, where hot air, hot exhaust gas or dry air or exhaust gas having a temperature higher than ordinary temperature is blown onto the surface layer of the mix bed and sucked through window boxes 9A at a negative pressure of about 1000 to 2000 mmAq, to thereby dry said surface layer until an amount of moisture equal to 3 to 25% of the total moisture content of the mix is discharged out of the sintering system before the mix is ignited for sintering. The indicated level of moisture is effectively discharged from the sinter bed into the external environment by using the hot air recovered from a cooler 15 that cools the sintered ore or the hot exhaust gas obtained from the discharge end of the main duct 10. The two methods are now described specifically by reference to FIG. 9. According to the first method that uses the hot air from the cooler 15, a selected exhaust port 16 of the cooler 15 that provides hot air having a predetermined temperature is connected to a conduit 19 through which the hot air is supplied to the preheat/drying furnace 28 and sucked by the main blower 12 by way of the window box 9A, main duct 10 and dust precipitator 11, thus drying as well as preheating the surface layer of the mix bed to discharge 3 to 25% of the total moisture content of the mix from the sintering system. The temperature of the air to be supplied is at least 100° C. which is effective for drying purpose but should not exceed 500° C. above which coke may ignite. To prevent dust-induced troubles such as an obstructed conduit or nozzle, the hot air should not contain more than 2.0 g/$Nm^3$, preferably not more than 1.0 g/$Nm^3$, of fine dust. According to the second method that uses the hot exhaust gas from the main duct 10, an intake duct 18 is connected to the main duct on a selected point at the discharge end of the main duct that provides hot exhaust gas having a predetermined temperature, and said hot exhaust gas is supplied through the duct 18 to the preheat/drying furnace 28 by way of a flow control valve 17, dust precipitator 11', suction blower 12' and a conduit 20. The preheat/drying furnace 28 may employ dry air or exhaust gas having a higher-than-ordinary temperature as well as hot air and exhaust gas. However, the use of such dry air or exhaust gas is less effective in preheating the surface layer of the raw material mix, and as a result, the advantage of this invention relating to smaller consumption of coke and COG is reduced. In FIG. 9, the numeral 9 is a sinter crusher, and 14 is a vibrating feeder.

As illustrated in the embodiment of FIG. 9, the process of this invention dries the surface layer of the raw material mix bed on the pallets 7 to discharge 3 to 25% of the total moisture content of the feed from the sintering system before said mix is transferred to the ignition furnace. The moisture content being discharged may be detected and controlled to rest within a predetermined range by either of the methods described hereinabove: the method of using a flue exhaust gas moisture meter and a Pitot tube to determine the content of moisture being discharged and controlling the flow rate and temperature of the dry gas as well as the travelling speed of the pallets so that said moisture content is within the predetermined range, or the method of measuring the temperature of the exhaust gas discharged instead of measuring the moisture content of the gas to thereby calculate the moisture content discharged from the mix and effecting the same control as in the first method, or the method of detecting the thickness of a dry moisture-free zone (100° C. or more) with a thermometer inserted in the sinter bed and using the measured thickness of the zone, the thickness of the mix bed and the desired percentage of moisture to be discharged, to control the thickness of said zone so that it may agree with the predetermined value.

As described in the foregoing, the process of this invention dries the surface layer of the raw material mix on the pallets of a Dwight-Lloyd machine to discharge 3 to 25%, preferably 5 to 20%, of the total moisture content of the mix from the sintering system before it is ignited for sintering. In consequence, less water is condensed in the intermediate and bottom layers of the sinter bed after ignition, which in turn increases the number of voids present in the sinter bed. This results in the increased porosity, hence improved reducibility, of the sintered product. If air or exhaust gas heated to at least 100° C. is used to dry the surface layer of the mix, the surface layer of the sinter bed is preheated, and this helps reduce the consumption of coke and COG. As a result, the FeO content of the sintered ore is decreased and the reducibility of the product is improved, accordingly.

The process of the invention can comprise, consist essentially of or consist of the steps set forth and the material employed can comprise, consist essentially of or consist of those set forth.

The entire disclosure of Japanese priority application Ser. No. 144587/78 filed on Nov. 22, 1978 is hereby incorporated by reference.

What is claimed is:

1. A process for producing sintered ore with high reducibility by sintering a raw material mix of a moisture content between 5 and 7% pallets of a sintering machine, which comprises drying the surface layer of said mix on the pallets so that it is dried by a thickness equal to 8 to 31% of the thickness of the mix bed, and thereafter igniting the surface layer of the mix to sinter the same with air or gas sucked downward.

2. A process according to claim 1 wherein the moisture content of the raw material mix is about 6%.

* * * * *

UNITED STATES PATENT AND TRADEMARK OFFICE

CERTIFICATE OF CORRECTION

PATENT NO. : 4,317,676

DATED : March 2, 1982

INVENTOR(S) : SOUMA, H.; KONNO, N.; HOSOTANI, Y.; and SHIBATA, J.

It is certified that error appears in the above-identified patent and that said Letters Patent is hereby corrected as shown below:

IN THE CLAIMS:

Claim 1, line 3, after "7%", insert --on--.

Signed and Sealed this

*Seventeenth* Day of *August 1982*

[SEAL]

*Attest:*

GERALD J. MOSSINGHOFF

*Attesting Officer* *Commissioner of Patents and Trademarks*